US005233779A

United States Patent [19]

Shaw

[11] Patent Number: 5,233,779

[45] Date of Patent: Aug. 10, 1993

[54] RIFLE REST

[76] Inventor: Bernard W. Shaw, HCR Box 100, Needmore, Pa. 17238

[21] Appl. No.: 933,825

[22] Filed: Aug. 24, 1992

[51] Int. Cl.[5] ..... F41A 23/00

[52] U.S. Cl. ..... 42/94

[58] Field of Search ..... 42/94; 89/37.03, 37.04; 248/105, 910

[56] References Cited

U.S. PATENT DOCUMENTS

| | | | |
|---|---|---|---|
| 3,012,350 | 12/1961 | Wold . | |
| 3,935,657 | 2/1975 | Wade . | |
| 4,449,314 | 5/1984 | Sorensen . | |
| 4,790,096 | 12/1988 | Gibson . | |
| 4,821,443 | 4/1989 | Bianco | 42/94 |
| 5,058,302 | 10/1991 | Minneman . | |

OTHER PUBLICATIONS

The American Rifleman, Jan. 1977, p. 52, vol. 125, No. 1.

*Primary Examiner*—Harold J. Tudor
*Attorney, Agent, or Firm*—Brady, O'Boyle & Gates

[57] ABSTRACT

A rifle rest wherein a pair of rectangular, superimposed, sand-filled canvas bags are stitched together along their longitudinal center lines to thereby form a pair of upper lobes and a pair of lower lobes hingedly connected along the stitch line. When the lower lobes are moved in a direction away from each other, the upper lobes are simultaneously moved in a direction toward each other to thereby grip the stock and barrel of a rifle to be supported.

13 Claims, 2 Drawing Sheets

FIG. 1
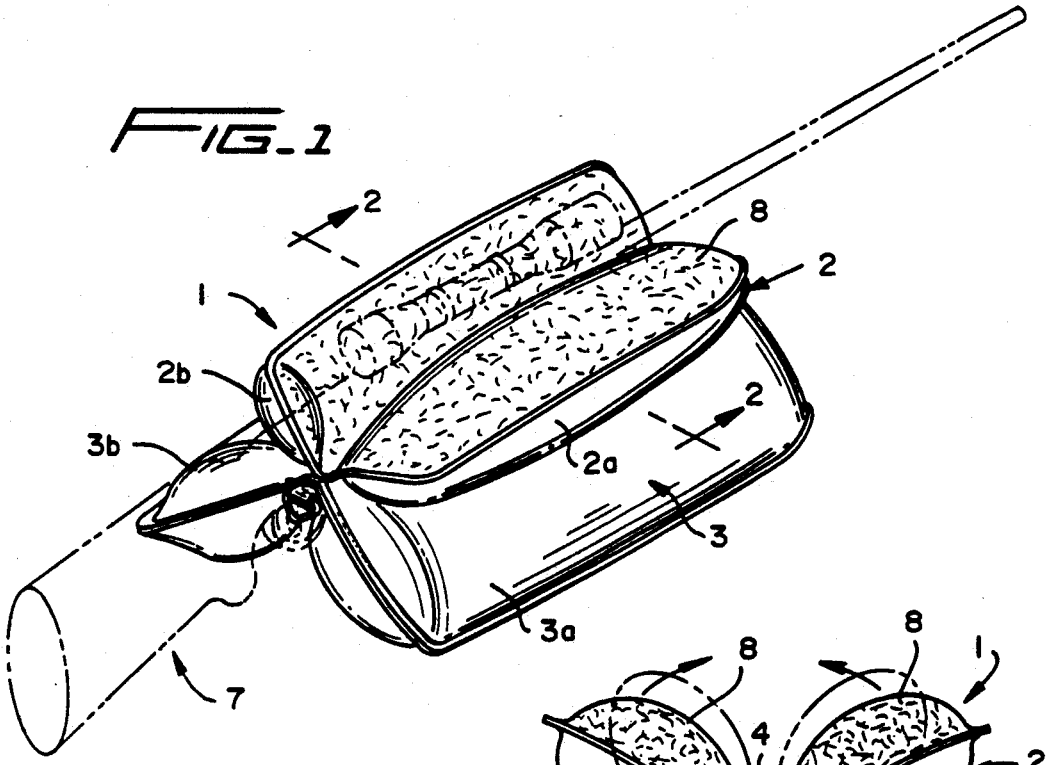
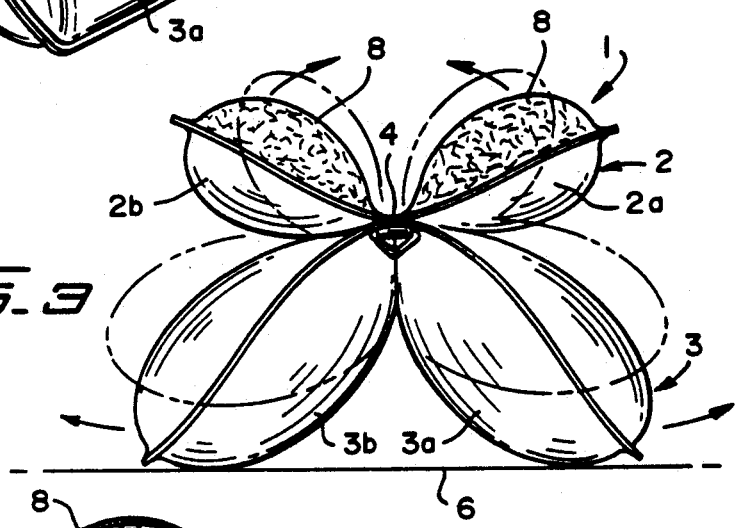
FIG. 3
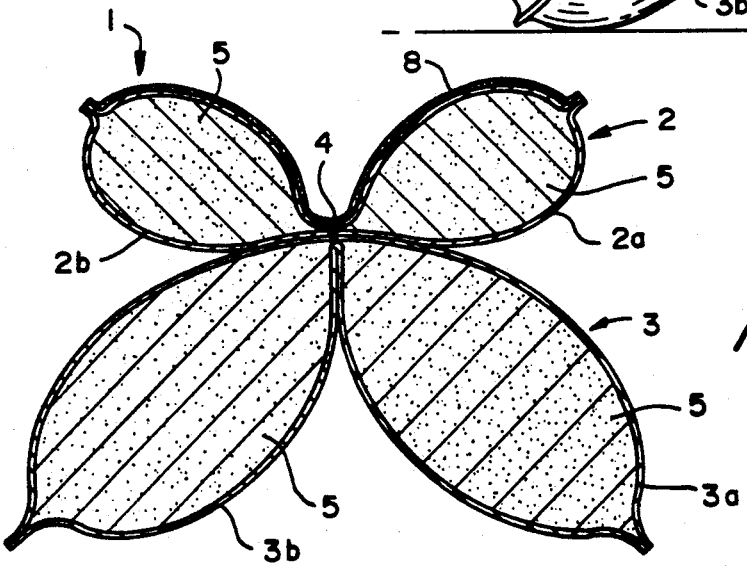
FIG. 2

RIFLE REST

BACKGROUND OF THE INVENTION

Various rifle rests have been proposed for supporting rifles for hunting or target shooting. These rests have usually consisted of frame members having mechanical clamps for securing the rifle to the frame member. While these rests or supports have been generally satisfactory for their intended purpose, they have been characterized by certain disadvantages such as being cumbersome and therefore not easily carried from place-to-place. Furthermore, the clamps, when tightened, had a tendency to scratch or otherwise damage the rifle stock and barrel.

After considerable research and experimentation, the rifle rest of the present invention has been devised to overcome the disadvantages experienced with conventional rifle rests and is constructed and arranged to be easily carried to the firing site, and manipulable to fixedly support a rifle without scratching or damaging the rifle stock and barrel.

SUMMARY OF THE INVENTION

The rifle rest of the present invention comprises, essentially, a pair of rectangular, superimposed, sand-filled canvas bags. The bags are stitched together along their longitudinal center lines to thereby form a hinge. The bags are filled with sand to such a degree that the lower bag provides a base support having a pair of lobes or wing portions adapted to rest on a supporting surface, such as a bench or the ground, and the upper bag has a similar pair of smaller lobes or wing portions adapted to support a rifle.

When the lobes of the lower bag are pivoted about the hinge toward each other, the lobes of the upper bag are simultaneously moved in a direction away from each other. The rifle to be supported is then placed into the space between the upper lobes, and the lower bag lobes are then manually pivoted in a direction away from each other, resulting in the upper lobes moving in a direction toward each other, to thereby grip the rifle placed therebetween.

A friction surface, such as suede, is applied to the outer surfaces of the upper lobes to enhance the gripping action of the rifle rest, and a shoulder strap is detachably connected to the rest to facilitate carrying the rest to the shooting site.

BRIEF DESCRIPTION OF THE DRAWINGS

FIG. 1 is a perspective view of the rifle rest of the present invention, oriented in the operative position to support a rifle shown in phantom;

FIG. 2 is a view taken along line 2—2 of FIG. 1:

FIG. 3 is an end elevational view of the rifle rest of the present invention showing the movement of the lower bag lobes and upper bag lobes to grip the rifle shown in phantom in FIG. 1;

DESCRIPTION OF THE PREFERRED EMBODIMENT

Figure 4:
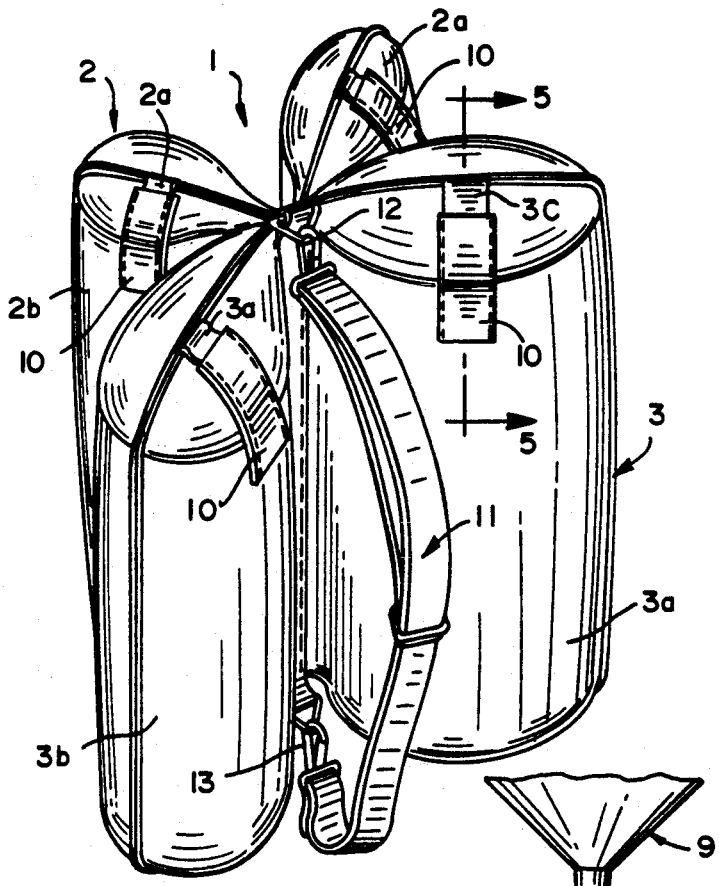
FIG. 4 is a perspective view of the rifle rest of the present invention oriented in a non-use position to show the sand-filling sleeves and shoulder strap.

Referring to the drawings and more particularly to FIGS. 1, 2 and 3, the rifle rest 1 of the present invention comprises a pair of rectangular, superimposed, canvas bags 2 and 3 stitched together along their longitudinal center lines as at 4, to thereby form a hinge. The bags 2 and 3 are filled with sand 5 to such a degree that the lower bag provides a base support having a pair of lobes 3*a*, 3*b* adapted to rest on a supporting surface 6, such as a bench or the ground, and the upper bag 2 has a similar pair of smaller lobes 2*a* and 2*b* adapted to support a rifle 7.

A friction surface 8, such as suede, is applied to the outer surfaces of the upper lobes to enhance the gripping action of the rifle rest 1 on the rifle 7.

In use, when the lobes 3*a* and 3*b* of the lower bag 3 are manually pivoted about the hinge 4 toward each other, the lobes 2*a* and 2*b* of the upper bag 2 are simultaneously moved in a direction away from each other. The rifle 7 to be supported is then placed into the space between the upper lobes 2*a*, 2*b*, and the lower bag lobes 3*a*, 3*b* are then manually pivoted in a direction away from each other, as shown in FIG. 3, resulting in the upper lobes 2*a* and 2*b* moving in a direction toward each other, to thereby grip the rifle 7 placed therebetween.

Figure 5:
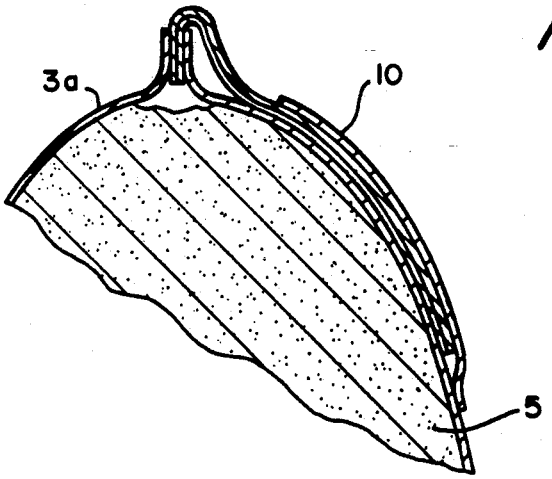
FIG. 5 is a view taken along line 5—5 of FIG. 4.
Figure 6:
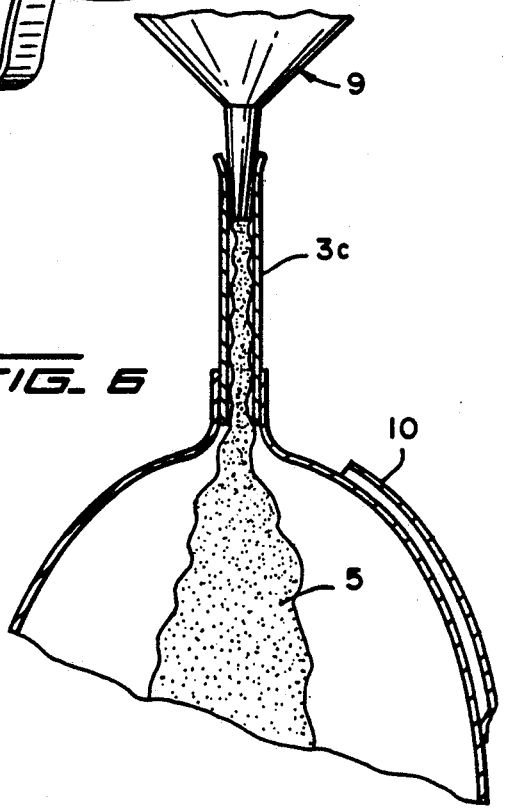
FIG. 6 is a fragmentary sectional view of one of the bag lobes illustrating the filling of the bag with sand.

To complete the structural description of the rifle rest, FIGS. 4 to 6 disclose the method by which the bags 2 and 3 are filled with the sand 5. To this end, a sleeve 2*c*, 2*d*, 3*c*, 3*d* is secured to an end of a respective lobe 2*a*, 2*b*, 3*a*, 3*b* and communicates with the interior of the respective lobe as shown in FIG. 6. A funnel 9 is inserted into the sleeve 3*c* and the sand 5 is poured through the funnel 9 into the bag until the bag is made firm. The sleeve 3*c* is then pinched closed and folded downwardly along the side of the lobe 3*a* and inserted into a pocket 10 secured to the side of the lobe, it being understood that pockets 10 are similarly provided for the other filling sleeves 2*c*, 2*d*, 3*d*, as shown in FIG. 4.

To facilitate carrying the rest 1, an adjustable shoulder strap 11 is detachably connected to the bags 2 and 3 as at 12 and 13 on the longitudinal center line thereof.

From the above description, it will be appreciated by those skilled in the art that the rifle rest is an improvement on prior rests in that the rest is easily transported; it can be quicly manipulated to clamp the rifle without damaging the rifle stock or barrel.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A rifle rest comprising, a pair of superimposed bags, means for connecting said bags to thereby form a hinge therebetween, particulate material filling said bags to thereby form a pair of lobes on each bag on each side of said hinge, the lobes on the lower bag positioned on a supporting surface, and the lobes on the upper bag gripping a rifle.

2. A rifle rest according to claim 1, wherein the superimposed bags are made of canvas and the hinge comprises stitches connecting the bags together.

3. A rifle rest according to claim 1, wherein the particulate material comprises sand.

4. A rifle rest according to claim 1, wherein a flexible filling sleeve is connected to each lobe communicating with the interior thereof, whereby the bags are filled with the particulate material.

5. A rifle rest according to claim 4, wherein a pocket is secured to each lobe in proximity to the filling sleeve, whereby the sleeve is inserted into the pocket after the lobe has been filled.

6. A rifle rest according to claim 1, wherein a friction surface is applied to the lobes on the upper bag to thereby facilitate the gripping of the rifle.

7. A rifle rest according to claim 1, wherein a shoulder strap is connected to the rifle rest to facilitate the carrying thereof.

8. A rifle rest comprising, a pair of rectangular, superimposed fabric bags, said bags being stitched together along their longitudinal center lines to thereby form a hinge, sand filling each bag to thereby form a pair of lobes on each side of said hinge, the lobes on the lower bag adapted to be positioned on a supporting surface, the lobes on the upper bag adapted to grip a rifle, whereby when the lower lobes are pivoted in a direction toward each other, the upper lobes move in a direction away from each other to thereby provide a space to accommodate the stock and barrel of the rifle to be supported, and when the lower lobes are moved in a direction away from each other, the upper lobes move toward each other to thereby grip the stock and barrel of the rifle.

9. A rifle rest according to claim 8, wherein the upper lobes are smaller than the lower lobes.

10. A rifle rest according to claim 8, wherein a flexible filling sleeve is connected to each lobe communicating with the interior thereof, whereby the bags can be filled with the sand.

11. A rifle rest according to claim 10, wherein a pocket is secured to each lobe in proximity to the filling sleeve, whereby the sleeve is inserted into the pocket after the lobe has been filled.

12. A rifle rest according to claim 8, wherein a friction surface is applied to the upper lobes to thereby facilitate the gripping of the rifle.

13. A rifle rest according to claim 8, wherein a shoulder strap is detachably connected to the rifle rest and extends along the longitudinal center lines of the bags.

* * * * *